US005690492A

United States Patent [19]

Herald

[11] Patent Number: 5,690,492

[45] Date of Patent: Nov. 25, 1997

[54] DETECTING TARGET IMAGED ON A LARGE SCREEN VIA NON-VISIBLE LIGHT

[75] Inventor: Gordon L. Herald, Bel Air, Md.

[73] Assignee: The United States of America as represented by the Secretary of the Army, Washington, D.C.

[21] Appl. No.: 683,272

[22] Filed: Jul. 18, 1996

[51] Int. Cl.[6] ..... F41G 3/26; F41J 5/10

[52] U.S. Cl. ..... 434/20; 463/5; 463/51

[58] Field of Search ..... 434/11, 14–16; 273/358; 463/5, 51–53; 345/156, 158, 181; 250/252.1 A; 349/5

[56] References Cited

U.S. PATENT DOCUMENTS

| | | | |
|---|---|---|---|
| 4,290,757 | 9/1981 | Marshall et al. | 434/20 X |
| 4,336,018 | 6/1982 | Marshall et al. | 434/20 X |
| 4,496,158 | 1/1985 | Baer | 463/5 |
| 4,824,324 | 4/1989 | Hendry et al. | 434/21 X |
| 5,194,008 | 3/1993 | Mohan et al. | 434/20 X |
| 5,215,464 | 6/1993 | Marshall et al. | 434/22 |
| 5,321,263 | 6/1994 | Filo | 250/316.1 |
| 5,541,746 | 7/1996 | Hamagish et al. | 349/5 X |

*Primary Examiner*—Richard J. Apley
*Assistant Examiner*—John Mulcahy
*Attorney, Agent, or Firm*—Freda L. Krosnick; Paul S. Clohan

[57] ABSTRACT

A device to determine which target a participant has selected during simulated weapon training is disclosed. The device uses a second projector in addition to the computer generated image projector to project a non-visible light onto a screen. The computer generated imagery projector and the non-visible light projector are adjusted to create a composite image, visible and non-visible, projected on the screen such that the non-visible image is overlaid on the visible image at all times. The non-visible image contains information related only to certain pre-defined targets. The participant is able to sense the visible portion of the image on the screen but not the non-visible image, which is reflected from the screen to an electronic sensor that senses only the non-visible image. A computer processes the information obtained from the sensor to determine which target the participant has selected.

4 Claims, 2 Drawing Sheets

DETECTING TARGET IMAGED ON A LARGE SCREEN VIA NON-VISIBLE LIGHT

GOVERNMENTAL INTEREST

The invention described herein may be manufactured, used and licensed by or for the United States Government without payment to me of any royalty thereon.

TECHNICAL FIELD

The present invention relates generally to the field of training devices and their component features, and more specifically to devices that offer interactive simulated weapon system training by having images projected upon a screen.

BACKGROUND ART

In a man-in-the-loop, real-time target simulation the participants (trainees) are interacting in a simulated or virtual reality environment which can consist of a large theatrical type screen on which a fixed or time changing visible video image is projected. The target image, such as an aircraft, for this application is created by a computer generated imagery system in which all the images are constructed from computer data bases and the attributes of the image are known including the screen coordinates of the objects projected onto the screen.

The complete computer generated image can consist of objects which depict the outside world including trees, hills, roads, buildings and other such objects. Moving and static objects defined as targets also appear in the overall image. For example, the target objects may consist of aircraft, helicopters, trucks, personnel, buildings and other military or industrial type targets. It is also possible that the image and targets could be symbolic in style for other applications. Generally, the computer generated image is projected on the imaging screen by video projectors.

In the above described simulation, the participants are provided with a targeting device such as a simulated weapon, such as a rifle or surface-to-air missile launcher, or other pointer device which has a sighting system to allow the participant to aim the targeting device at a selected target. The participant activates a trigger to indicate to the computer system which target has been selected and the action which the participant desires. The computer and its related image generation system then applies visible changes to the target to indicate a "hit" or a "miss" or some other type of damage.

In current available simulation systems, the simulated weapon or pointing device is generally instrumented with a system that determines the x, y, z, pitch, roll, yaw and attitude parameters of the device as referenced to a simulation database. These instrumentation systems use magnetic, acoustic, or pattern recognition methods to determine the position and attitude parameters. These position and attitude parameters can be related to simulation image data in order to determine which target the participant is pointing to or aiming at. Other systems use video image analysis and interpretation to determine the possibility of a target, and determine which target is selected.

The prior art methods do not work well in some simulation environments or they are too complex to use in a real-time, man-in-the-loop simulation environment. For example, the accuracy of magnetic systems is affected by nearby metal objects and fields from equipment such as CRT's. Also, magnetic sensor systems cannot be mounted on metals which affect the magnetic fields of the system.

Acoustical systems have limited range between the source and sensor and have accuracy limitations. Video image analysis and interpretation is computationally complex, time consuming, and not highly reliable due to target image quality problems and the large number of possible target aspects that must be considered.

STATEMENT OF THE INVENTION

It is therefore an object of the present invention to provide a device to accurately detect which of several target images projected on a large theatrical type screen is being aimed at during interactive weapon system simulation training.

A further object of the present invention is to provide a non-visible, light based method and apparatus wherein it is possible to identify which one of several target images that are visible on a large theatrical type image screen is being pointed at that does not require magnetic sensors, acoustical sensors, or image analysis.

A still further object is to provide a means for target identification during imaged simulation training that does not interfere with the visible image.

Still other objects and advantages of the present invention will become readily apparent to those skilled in this art from the detailed description, wherein only the preferred embodiment of the present invention is shown and described, simply by way of illustration of the best mode contemplated of carrying out the present invention. As will be realized, the present invention is capable of other and different embodiments, and its several details are capable of modifications in various obvious respects, all without departing from the present invention. Accordingly, the drawings and descriptions are to be regarded as illustrative in nature, and not as restrictive.

These and other objects are achieved by providing a device to determine which target a participant has selected during simulated weapon training is disclosed. The device uses a second projector in addition to the computer generated image projector to project a non-visible light onto a screen. The non-visible projector consists of a high intensity light source such as one or more strobe lights, infrared pass filters, a lens system, and a dynamically positioned aperture system which uses a liquid crystal display. The strobe lights are capable of producing an intense, short burst of light. A light controller triggers each strobe light in order to produce a pulsed light stream of a desired pattern. A serial light pulse pattern (analogous to the "1" or "0" binary states, where logic "0" is zero volts and logic "1" is at 5 volts) will be generated where a logic "1" is represented by a pulse of light and a logic "0" is represented by the absence of a light pulse. The pulsed light stream is analogous to an asynchronous computer communication data link control protocol and can consist of up to 8 data pulses, which provide up to 255 target identification numbers. Data pulses are framed by a start pulse at the beginning and ending with a stop pulse.

The computer generated imagery projector and the non-visible light projector are adjusted to create a composite image, visible and non-visible, projected on the screen such that the non-visible image is overlaid on the visible image at all times. The non-visible image contains information related only to certain pre-defined targets. The participant is able to sense the visible portion of the image on the screen but not the non-visible image, which is reflected from the screen to an electronic IR sensor that senses only the non-visible image. This reflected non-visible light is converted to pulsed electrical signals by the sensor, and outputted to an interface where it is further processed to adjust the signal output levels to those required by the computer input port. Software in the computer determines which target is currently being pointed at by the participants pointing device or simulated weapon.

DETAILED DESCRIPTION OF THE PREFERRED EMBODIMENT

Figure 1:
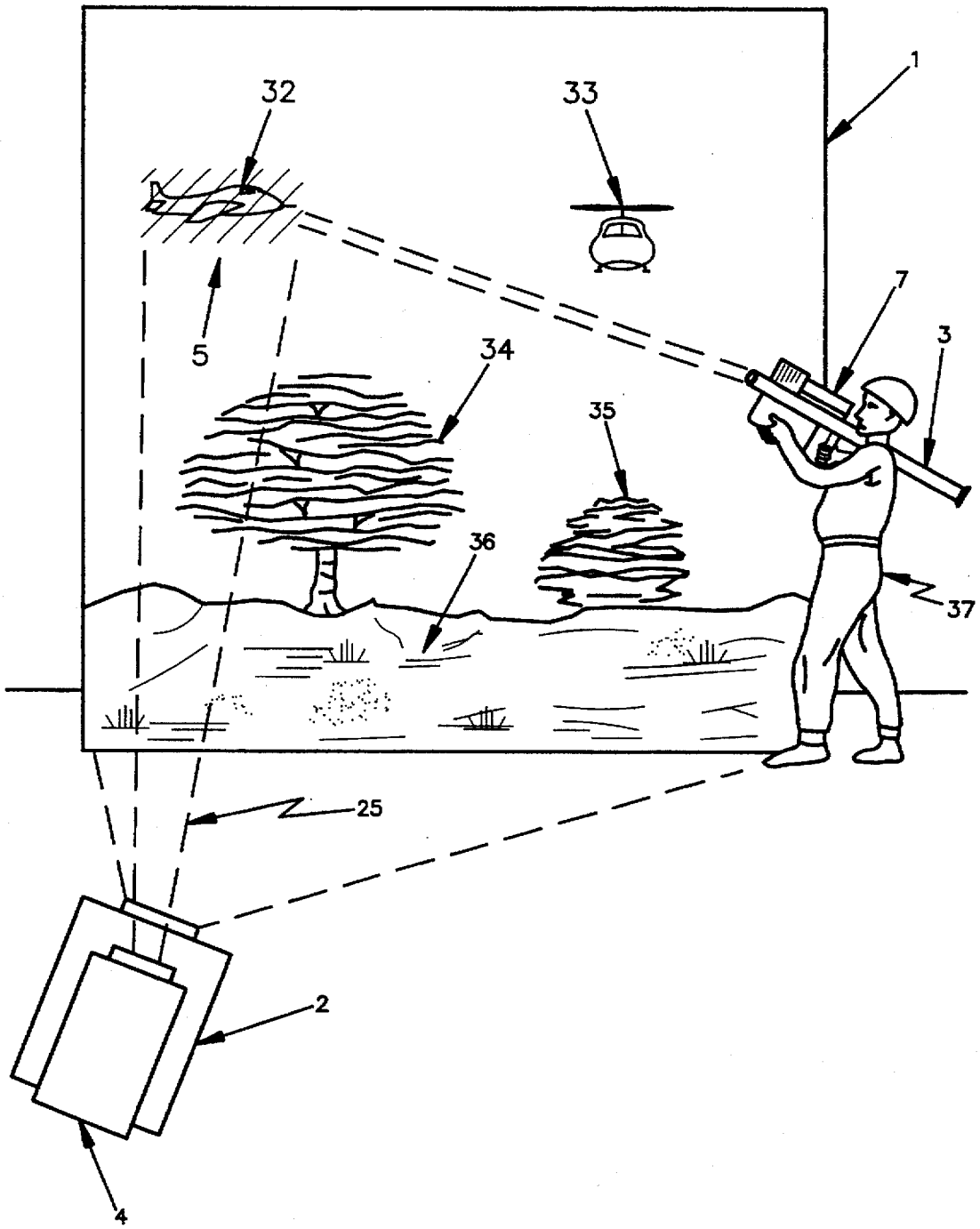
FIG. 1 depicts a participant aiming a simulated rocket launcher at a simulated target projected on a large screen.

Referring now in detail to the drawings wherein like parts are designated by like reference numerals throughout, there is illustrated in FIG. 1 a participant 37 aiming a simulated weapon 3 at a simulated target 32 projected on a large theater-type screen 1 by computer generated imagery projector 2. Target 32 is shown as an aircraft, but can be any number of simulated threats, such as a missile, ship, tank, or, as shown, helicopter 33. Other terrain features are also being projected by projector 2 such as trees 34 and 35, and ground 36. Other features can be projected as desired by the particular simulation.

In addition to computer generated imagery projector 2, a non-visible light projector 4 is provided. Projector 2 and projector 4 are adjusted to create a composite target image; the visible portion is represented by target 32, seen by participant 37, and the non-visible image 5, not seen by participant 37, but reflected off screen I to sensor 7 located on weapon 3. Non-visible image 5 is overlaid on target 32 by projector 4, is correlated to visible image 32 at all times, and contains information related only to defined targets. In other words, non-visible image 5 is only overlaid on targets 32 and 33, but not on the non-target images 34, 35, and 36.

Figure 2:
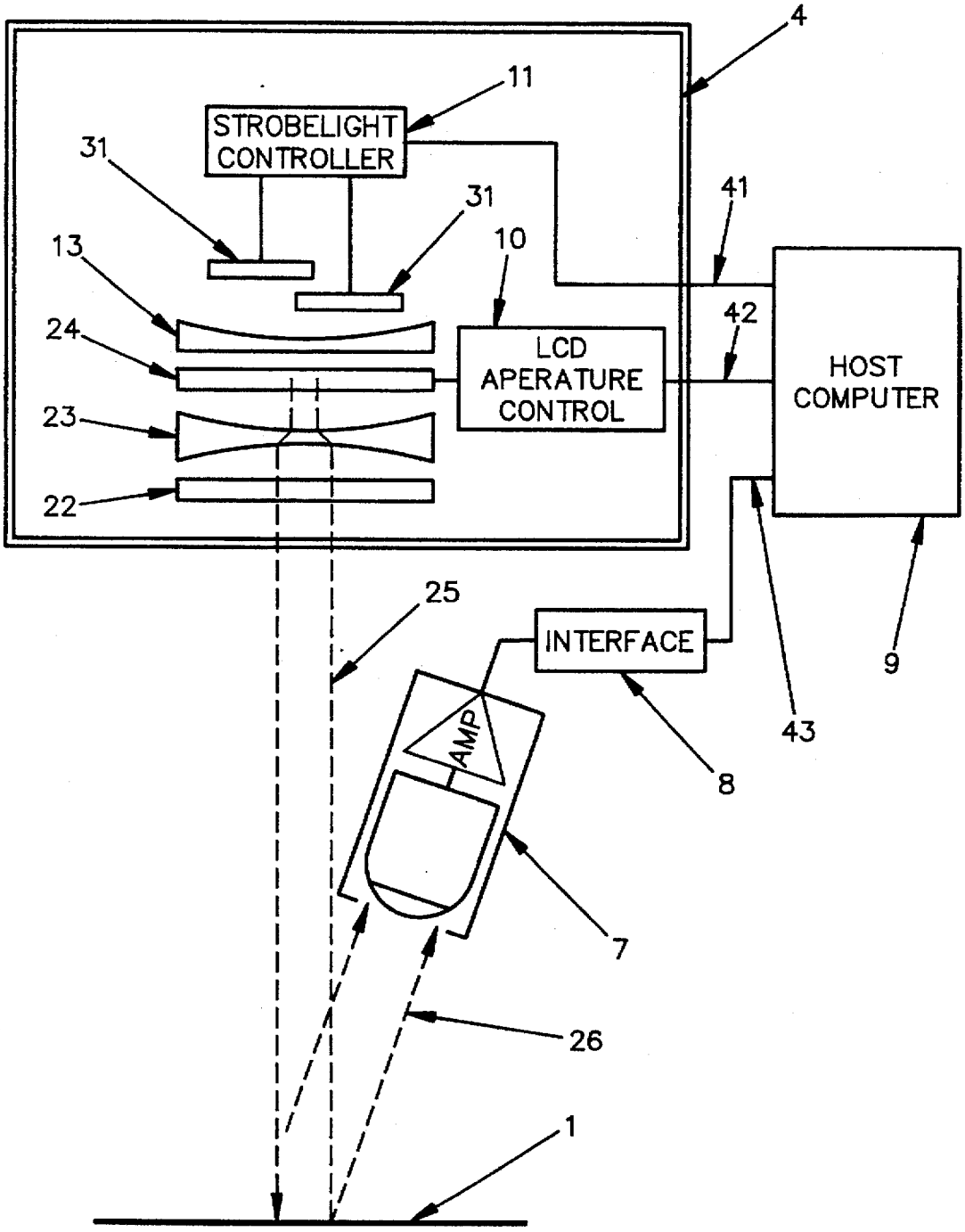
FIG. 2 is a block diagram of the present invention.

Operation and design of the present invention is best shown in FIG. 2. Within non-visible projector 4 light is transmitted by one or more strobe lights 31, controlled by strobe light controller 11 which is in turn controlled by computer 9 via data line 41. Strobe light systems require a short recovery time after the light burst is generated before they can be triggered again to provide a subsequent light burst. For applications where the light pulse pattern requires a rapid light pulse stream which cannot be generated by a single strobe light, a system of using two or more strobe lights can be used as shown. When two or more strobe lights are used, strobe light controller 11 will output triggers to the strobe lights in a sequential mode to enable light pulses to be generated by one of the strobe lights which is no longer in the recovery state. The light emitted by strobe lights 31 is received by a lens 13 which spreads the light over the surface of a dynamic light positioning aperture 24. Light positioning aperture 24 consists of a liquid crystal display (LCD) in which a small light transmitting area (aperture) is created by LCD aperture controller 10 which is controlled by computer 9 via data line 42. This aperture corresponds to the screen position of the target and is maintained in a transmitting state for the duration of the non-visible light pulses associated with that particular target. The remainder of LCD 24 is in the light absorbing state. Although an aperture is created for each target, there is only one aperture open at any one time. A second lens 23 and an infrared (IR) pass filter 22, on the light output side of LCD 24 focuses the pulsed IR light beam 25 on screen 1. For each target, a new aperture is created and the position of the aperture on LCD 24 is determined by the coordinates of the target on screen 1. Each aperture is maintained for the duration of the non-visible light pulses 25 which identify the target. The position of the apertures is at the video frame rate or a sub-frame rate of the computer generated imagery system (for a 30 Hz frame rate the aperture position will be maintained for 33 milliseconds). Apertures are created one after the other for each target. After the last target aperture has been completed, the aperture sequence will be started again for all remaining targets in the visual field.

Detection of a target is accomplished as follows. The pulsed IR light beam 25 is reflected off screen 1 in a reflected beam 26 to a reflected IR sensor 7 located on weapon 3. Sensor 7 can be tubular with a lens system at the front and a photo detector at the rear as shown. The tube size and lens system are designed to limit its' field-of-view such that only the non-visible light reflected from a limited area of screen 1 is incident on the photo detector. This allows target discrimination and prevents interference from the reflected non-visible light of other possible nearby targets. Reflected beam 26 detected by the photo detector in sensor 7 has the pulse characteristics generated by the non-visible light projector 4 at each target position on screen 1. Reflected light 26 carries the same unique pulse pattern for each target that was originally generated by projector 4 light pulse stream which provides a target identification number for each target. A stop filter, or an equivalent optical device is placed at the output of the computer generated imagery projector 2 in order to allow passage of the visible light which composes the image and stops the non-visible light to which the photo detector is sensitive.

Sensor 7 has electronic circuitry to convert the serially pulsed light data to a serially pulsed electronic signal. An interface 8 receives the output of the IR sensor 7 and converts it to acceptable voltage levels and polarity for transmission to host computer 9 via data line 43. Target detection and recognition occurs upon decoding and processing of the serial electronic pulse stream by computer 9.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. A method for determining when a selected visible image among many visible images located on a surface is being aimed at by a pointing device comprising the steps of:

creating a pulsed light beam of high intensity;

transmitting said pulsed light beam through a dynamic light positioning aperture;

focusing said pulsed light beam emitted by said aperture;

filtering said focused light beam to create a focused, non-visible, pulsed light beam;

projecting said focused, non-visible, pulsed light beam upon said selected visible image;

sensing the reflection of said focused, non-visible, pulsed light beam from said surface by a sensing means located on said pointing device;

converting said sensed reflection to a signal;

processing said signal to indicate when said selected visible image is being aimed at by said pointing device;

wherein said step of creating a pulsed light beam of high intensity further comprises the step of generating a series of unique pulsed light beams of high intensity, each said unique pulsed light beam corresponding to a selected set of visible images located on said surface.

2. The method of claim 1 wherein said step of transmitting said series of unique pulsed light beams of high intensity, each said unique pulsed light beam corresponding to a selected set of visible images located on said surface, through a dynamic light positioning aperture, also comprises creating a unique aperture for each said unique pulsed light beams in said dynamic light positioning aperture.

3. A system for determining when a selected visible image among many visible images located on a surface is being aimed at by a pointing device, comprising:

means for creating a series of unique pulsed light beams of high intensity a dynamic light positioning aperture through which said series of unique pulsed light beams is projected;

means for focusing said series of unique pulsed light beams emitted through said aperture;

means for filtering said series of unique pulsed light beams to create a series of unique, non-visible, pulsed light beams;

means for controlling said dynamic light positioning aperture to project each said unique, focused, non-visible, pulsed light beam upon a different selected set of visible images among said many visible images;

a pointing device;

means for sensing the reflection of said focused, non-visible, pulsed light beams said surface by a sensing means located on said pointing device;

means for converting said sensed reflection into a signal;

means for processing said signal to indicate when said selected visible image is being aimed at by said pointing device.

4. The device of claim 3 wherein said means for controlling said dynamic light positioning aperture comprises means for creating a unique aperture for each said unique pulsed light beam in said dynamic light positioning aperture.

* * * * *